United States Patent [19]

Kim

[11] Patent Number: 4,822,090

[45] Date of Patent: Apr. 18, 1989

[54] SHOVEL FOR PLACER MINING

[76] Inventor: Kwang-Shick Kim, #551, Dockpoong-7Ri, Kongbu-up, Kwangju-gun, Kyungki-do, Rep. of Korea

[21] Appl. No.: 224,670

[22] Filed: Jul. 27, 1988

[30] Foreign Application Priority Data

Jul. 29, 1987 [KR] Rep. of Korea ..... 8252/1987

[51] Int. Cl.[4] ..... B07B 1/02

[52] U.S. Cl. ..... 294/49; 209/415

[58] Field of Search ..... 294/49–51, 294/57; 206/419, 418, 417, 447, 486, 614, 260

[56] References Cited

U.S. PATENT DOCUMENTS

| | | | |
|---|---|---|---|
| 661,774 | 11/1900 | Sheehy et al. | 209/419 |
| 1,306,931 | 6/1919 | Thomas | 209/419 |
| 4,289,241 | 9/1981 | Litrap | 209/443 |

*Primary Examiner*—James B. Marbert

*Attorney, Agent, or Firm*—Richard C. Woodbridge; Robert Charles Beam

[57] ABSTRACT

A shovel for placer mining for use in the riverbed including a shovel handle, a shovel blade fixedly attached to the handle with four elongated rectangular openings on its surface, a shovel scoop detachably screwed beneath the blade and formed with a concave bottom piece, two side plates and a rear plate with two elongated hexahedral projections all underneath a U-shaped flange having a stepped portion on its rim, a mesh screen placed beneath the blade on the top part of the scoop and forming a flat net enclosed in a U-shaped frame connected with a straight frame, a bottom lining forming the upper surface of the bottom piece and having the same curvature and size as the bottom piece enabling the projections of the scoop to hold a lining frame and therefore allowing the mining portion to mine minerals, namely placer gold.

1 Claim, 2 Drawing Sheets

SHOVEL FOR PLACER MINING

This invention relates to a shovel for placer mining, particularly to a shovel for placer mining capable for use in the riverbed.

BACKGROUND OF THE INVENTION

In mining placer gold in the riverbed, the use of a pan is a conventional practice. The pan is rolled from side to side, several times, in order to draw sand or gravel therein into a vortex. After removing the sand or gravel in the pan with the vortex flow of water, various minerals, namely placer gold, is left within the pan.

The conventional practice, however, required great skills to make the vortex flow, and was inefficient having a low productivity rate.

BRIEF SUMMARY OF THE INVENTION

This invention, therefore, is designed to solve the above problems and to overcome the mentioned disadvantages.

The objective of the invention is to provide a shovel for placer mining which has high productivity, high efficiency, and the capacity to reduce the amount of hard labor in the work of placer mining, especially, in areas where the work is done only by hand.

In accordance with the principles of the present invention, the shovel for placer mining which accomplishes the object is comprised of a shovel handle, a shovel blade fixedly attached to the handle, a shovel scoop which is detachably screwed underneath the shovel blade, a mesh screen placed beneath the shovel blade on the top part of the shovel scoop, and a bottom lining forming the upper surface of the bottom piece of the scoop.

BRIEF DESCRIPTION OF DRAWINGS

Other features and the advantages of the invention are apparent from the following description taken in relation to the accompanying drawings.

DETAILED DESCRIPTION OF THE INVENTION

Figure 1:
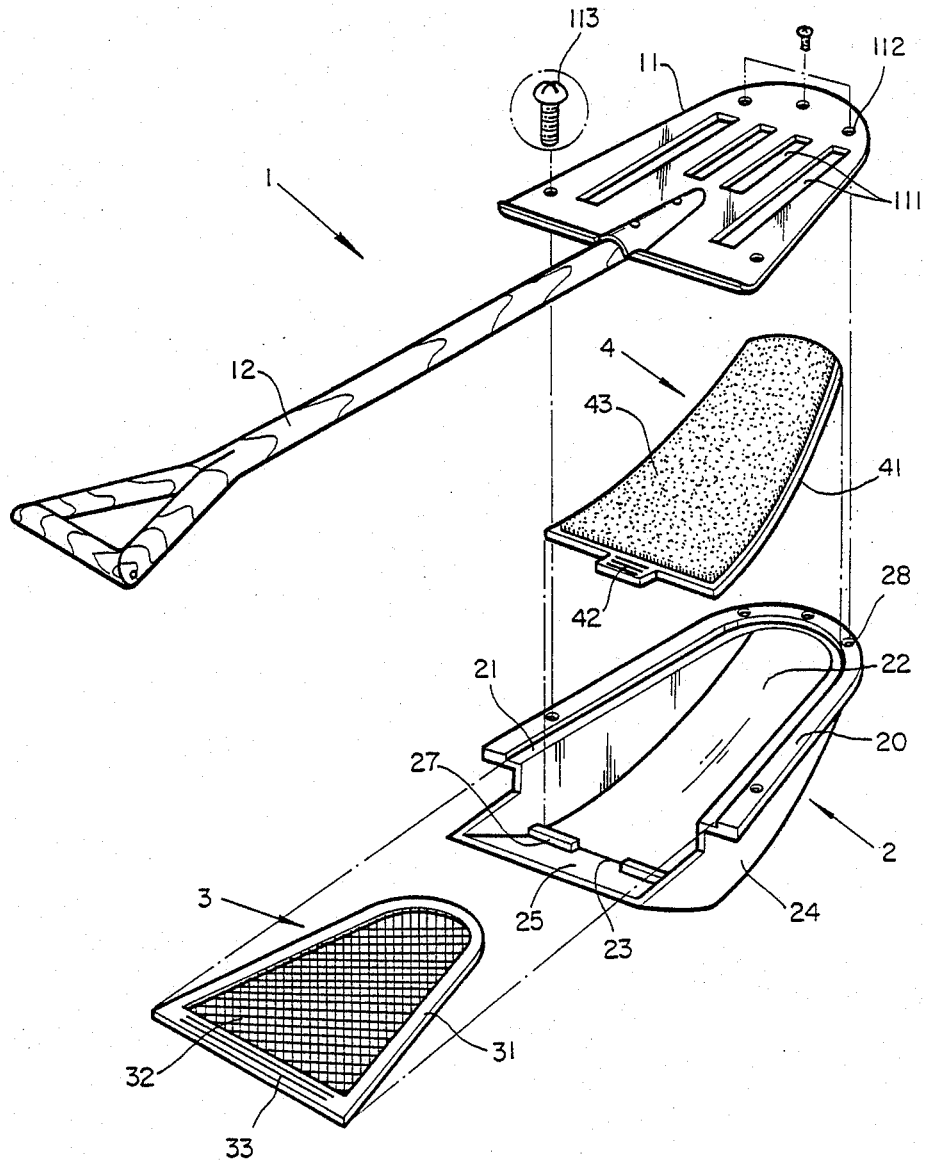
FIG. 1 is an exploded view of the shovel for placer mining in accordance with the invention.

Referring to the attached drawings of FIG. 1, a shovel for placer mining is shown to consist of a shovel handle 12, a shovel blade 11 fixed to the handle 12, a shovel scoop 2 detachably screwed underneath the blade 11, a mesh screen 3 placed beneath the shovel blade 11 on the top part of the shovel scoop, and a bottom lining 4 forming the upper surface of the bottom piece 22 of the scoop 2.

The shovel handle 12 is made of wood or plastic. The shovel blade 11 which is fixed to the handle 12 is flat and has four elongated rectangular openings 111 placed parallel to the handle 12. Two openings on the center of the blade 11 are shorter than the two openings on the outer side of the blade.

On the periphery of the blade 11, which is made of metal, are several female screws 112 for screwing the bolts 113.

The shovel scoop 2 is formed with a concave b tom piece 22, two side plates 24, a rear plate 25, two elongated projection 27, a U-shaped flange 20, and a stepped portion 21.

The concave bottom piece 22 extends to the front and is made of a material capable of bearing wear under sand or gravel. Two side plates 24 attached to the side end of the bottom piece 22 are facing each other. Furthermore, the side plates 24 are shaped into a three-sided figure, with the longest side curved almost like a part of an oval. The rear plate 25 is a flat trapezoid, adjoining the bottom piece 22 at an angle of approximately 140°; the sides of the rear plate 25 are respectively attached to the sides of the side plates and the bottom piece of the scoop.

On both ends of a junction line 23 between the bottom piece 22 and the rear plate 25 are two small elongated hexahedral projections 27. On the upper end of the bottom piece 22 and the two side plates 24 there is a U-shaped flange 20 which has several female screws 28 corresponding to the female screws 112 of the shovel blade 11. There is a stepped portion 21 adjacent to the flange, making an inner rim.

The mesh screen 3 is formed with a flat net 32, a U-shaped frame 31, and a widened portion with a straight frame 33. The U-shaped frame 31 is to be tightly inserted to the stepped portion 21 of the shovel scoop 2. The bottom lining 4 entraps the minerals, namely placer gold, by a filtering function, and has the same curvature and almost the same size as the bottom piece 22 of the shovel scoop 2 in order to adhere closely to the bottom piece.

The wider edge of the bottom lining 4 is hitched onto the shovel scoop 2 by the lining handle 42 placed through the space between the two hexahedral projections, and the projections hold the width of the lining on two sides (the width of the lining 4 being equivalent to the height of the projections 27).

The bottom lining 4 is composed of a frame 41, which is adhered closely to the bottom piece 22 of the scoop 2, a lining handle 42 attached to the frame 41, and a mining portion 43 which is fixed to the frame 41, which may be formed of artificial grass, flannel, velvet, etc.

To assemble, first of all, the mesh screen 3 is inserted within the stepped portion 21 of the shovel scoop 2; then the shovel blade 11 is put on top of the mesh screen 3 and the flange 20 of the shovel scoop 2 in order to bind the female screws 112 on the surface of the shovel blade 11 with the female screws 28 on the flange 20. Then the bolts 113 are screwed into the female screws of 112 and 28.

At this point, the bottom lining 4 is installed into the bottom piece 22 of the shovel scoop 2, either prior to inserting the mesh screen 3 into the stepped portion 21 at the rim of the shovel scoop 2, or posterior to screwing the shovel blade 11 to the flange 20 of the shovel scoop 2 with the bolts 113.

Figure 2:
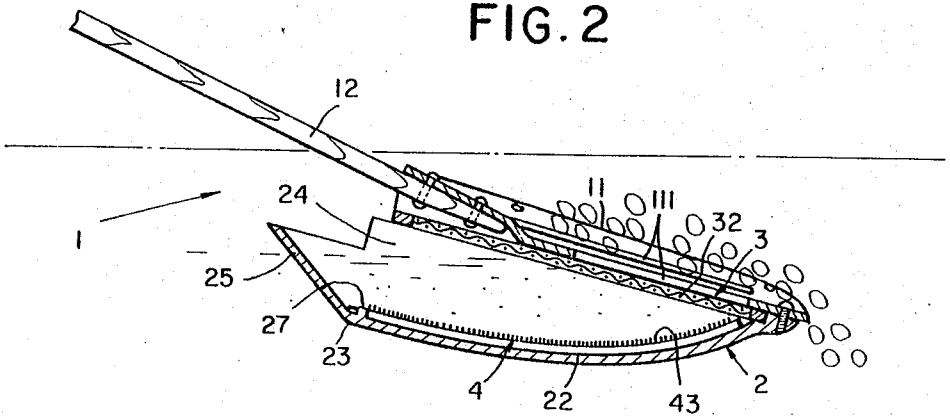
FIG. 2 is a cross-sectional view of the process of shovelling minerals, sand and gravel in the riverbed.

An explanation of the operation of this invention is as follows: referring to FIG. 2, the shovel scoops up the sand, gravel and minerals on the riverbed. As shown in FIG. 2, the shovel is moved up and down in the state where the shovel handle 12 is inclined in such an angle that it is higher than the shovel blade 11. The shovelling motion repeated several times in the water can separate the big sand particles and gravel from the small sand particles and minerals. The big particles slide off the shovel blade 11 and the small ones fall into the shovel scoop 2 through the elongated rectangular openings.

Once the particles enter through these openings, they pass through the mesh screen 3, and onto the mining portion 43.

Figure 3:
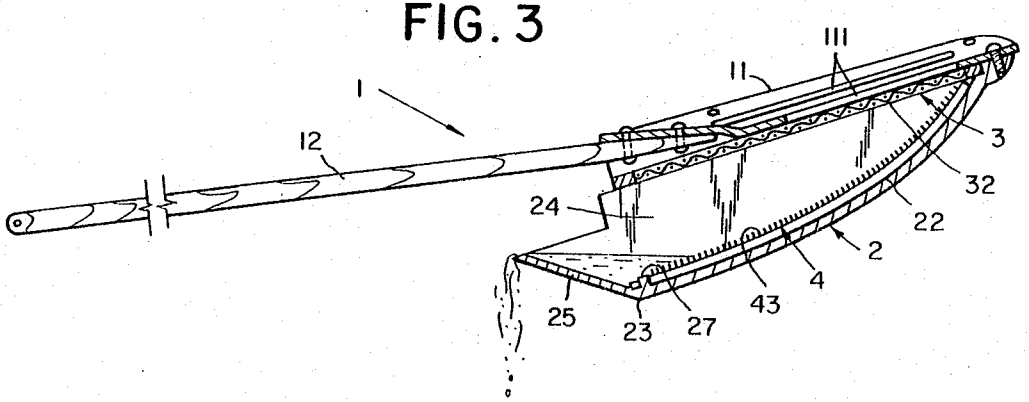
FIG. 3 is a cross-sectional view of the process of mining the minerals, removing them from sand and gravel.

This up-and-down-motion allows the water to come in and out of the shovel scoop 2, enabling the sand on the mining portion 43 of the bottom lining 4 to disperse minerals which are comparatively heavier than the sand remain on the mining portion 43 of the bottom lining in the shovel scoop 2. In the second shovelling, the remaining sand in the vicinity of the junction line 23 is discharged with the water when the shovel handle 12 is further inclined as shown in FIG. 3.

If this operation is repeated several times, plenty of minerals, namely, placer gold, will be mined in the mining portion 43 of the bottom lining 4. The bottom lining 4 on which the minerals are collected will simply be separated from the shovel scoop 2, if handle 42 of the bottom lining 4 is lifted off the bottom piece 22 of the shovel scoop 2, to the extent that the frame 41 of the bottom lining 4 is inclined higher than the hexahedral projections 27 of the shovel scoop 2. Then the bottom lining 4 can be pulled out of the shovel scoop 2. The bottom lining 4 can either be separated from the shovel scoop 2 to be used again after the minerals pile up at the mining portion 43 and move into a loading reservoir (not shown), or simply be replaced with a new one.

Thus, this invention of a shovel for placer mining can procure minerals, namely, placer gold, effectively and in a great quantity with a simple method and reduced effort.

It is further understood by those skilled in the art that the foregoing description is a preferred embodiment of the disclosed and that various changes and modifications may be made in the invention without departing from the spirit and scope thereof.

What is claimed is:

1. A shovel for placer mining for use in the riverbed, characterized by (a) a shovel handle, (b) a shovel blade, fixedly attached to the shovel handle, having four elongated rectangular openings on its surface aligned parallel to said shovel handle, (c) a shovel scoop detachably screwed beneath the shovel blade, said scoop comprising of a concave bottom piece capable of bearing wear with sand or gravel, two side plates attached to the side end of the bottom piece, a rear plate of flat trapezoid, two elongated hexahedral projections on both ends of a junction line between the bottom piece and the rear plate, a U-shaped flange screwed beneath the shovel blade, and a stepped portion formed on the inner side of the U-shaped flange, (d) a mesh screen placed beneath said shovel blade on the top part of said shovel scoop, tightly insertable to the stepped portion of said shovel scoop and forming a flat net enclosed by a U-shaped frame, and (e) a bottom lining being the upper surface of a bottom piece of said scoop, having the same curvature and size as the bottom piece so as to adhere tightly to said scoop, while at the edge of said bottom lining the two elongated hexahedral projections sandwiches a lining handle of said bottom lining onto said shovel scoop, thus enabling a mining portion of said bottom lining to mine minerals, namely placer gold.

* * * * *